US009227707B2

(12) United States Patent
Abeyta

(10) Patent No.: US 9,227,707 B2
(45) Date of Patent: Jan. 5, 2016

(54) SUPPLEMENTAL LIFESAVING SYSTEM INTEGRATED IN AN OBJECT

(71) Applicant: Joseph Abeyta, Weston, FL (US)

(72) Inventor: Joseph Abeyta, Weston, FL (US)

( * ) Notice: Subject to any disclaimer, the term of this patent is extended or adjusted under 35 U.S.C. 154(b) by 0 days.

(21) Appl. No.: 14/455,827

(22) Filed: Aug. 8, 2014

(65) Prior Publication Data

US 2015/0044923 A1 Feb. 12, 2015

Related U.S. Application Data

(60) Provisional application No. 61/863,664, filed on Aug. 8, 2013.

(51) Int. Cl.
*B63C 9/18* (2006.01)

(52) U.S. Cl.
CPC ..... *B63C 9/18* (2013.01)

(58) Field of Classification Search
CPC ..... B63C 9/18; B62B 1/00; B65D 25/00; A47J 47/14
USPC ..... 441/80, 92, 125; 220/560
See application file for complete search history.

(56) References Cited

U.S. PATENT DOCUMENTS

| | | | | | |
|---|---|---|---|---|---|
| 4,809,352 | A * | 2/1989 | Walker | ..... | 206/522 |
| 4,927,041 | A * | 5/1990 | Hepburn | ..... | 220/560 |
| 5,397,000 | A * | 3/1995 | Holte et al. | ..... | 206/545 |
| 5,738,557 | A * | 4/1998 | Biesecker | ..... | 441/92 |
| 7,543,828 | B2 * | 6/2009 | Vanderberg et al. | ..... | 280/47.26 |
| 8,544,872 | B2 * | 10/2013 | Vanderberg et al. | ..... | 280/47.26 |

* cited by examiner

*Primary Examiner* — Lars S Olson
(74) *Attorney, Agent, or Firm* — Mark Terry

(57) ABSTRACT

A marine lifesaving system is disclosed. A marine lifesaving system comprises an insulated container comprising a plurality of walls and a lid, at least one locking means to selectively and co-operatively secure said lid with said insulated container, at least one storage receptacle defined in one or more of the walls, or the lid, of the insulated container, at least one bladder system located in the at least one storage receptacle, at least one compressed gas canister connected to each of the at least one bladder systems, and an activation device for activating the at least one compressed gas canister, thereby inflating the at least one bladder system, wherein the activation device consists of a pull-string that extends exterior to the at least one storage receptacle.

13 Claims, 10 Drawing Sheets

SUPPLEMENTAL LIFESAVING SYSTEM INTEGRATED IN AN OBJECT

CROSS-REFERENCE TO RELATED APPLICATIONS

This patent application claims priority to provisional patent application No. 61/863,664 filed Aug. 8, 2013 and entitled "Supplemental Lifesaving System Integrated In an Object." The subject matter of provisional patent application No. 61/863,664 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The present invention relates to lifesaving flotation systems, and more particularly, to discreet supplemental lifesaving systems.

BACKGROUND OF THE INVENTION

Various marine lifesaving devices are commercially available, including floating devices of different shapes and sizes, life vests comprised of rigid foam or inflatable bladders, life rafts of varying shapes and personal watercraft. Many of the available marine lifesaving devices, however, have potential disadvantages. Floating devices, for example, may be ideal for victims who involuntarily fall over board, but if said victim is in an enclosed environment, such as a closed deck on a boat, wearing said device may be more dangerous than using no safety device at all, since the victim would be unable to swim underwater to escape the closed deck. Even a prolific swimmer would be incapable of escaping from a capsized vessel, if wearing a floating device when under a closed deck of the vessel. Therefore, many flotation devices that are made of foam materials are required to be located either on open decks or with direct access to an open environment. Similarly, life jackets are required to be onboard all water vessels but life jackets are not required to be worn by federal law (except for children under 13 or in states where a lifejacket law exists). Since they are not required to be worn, unlike a seatbelt in a car, life jackets are generally stowed in compartments and other locations on a vessel that are out of sight to prevent unnecessary wear and tear or from having them blown over board. Therefore, they are not easily accessible in time of emergency.

Life rafts are another means that are frequently used in lifesaving situations when someone involuntarily goes overboard a vessel, when a vessel capsizes or sinks or other emergency situations are encountered while on a vessel. However, most life rafts are large, expensive and not easily stowed onboard vessels. They are hard to access even in emergency situations when a vessel is capsizing or sinking, unless they are readily carried out in the open. Also, many of the commercially available life rafts are difficult to assemble and cannot be used in smaller vessels. Another problem with available lifesaving devices is that they can be large, bulky and cause visual clutter. In situations where visual aesthetics are important, such as on super-yachts and other high-end, luxury watercraft, large and bulky lifesaving devices can be unseemly and undesirable.

Consequently, a need exists to overcome the problems with the prior art, and particularly for a more efficient way of providing an onboard, readily accessible, lifesaving flotation system.

SUMMARY OF THE INVENTION

Briefly, according to an embodiment of the present invention, a marine lifesaving system is disclosed. A marine lifesaving system comprises an insulated container comprising a plurality of walls and a lid, at least one locking means to selectively and co-operatively secure said lid with said insulated container, at least one storage receptacle defined in one or more of the walls, or the lid, of the insulated container, at least one bladder system located in the at least one storage receptacle, at least one compressed gas canister connected to each of the at least one bladder systems, and an activation device for activating the at least one compressed gas canister, thereby inflating the at least one bladder system, wherein the activation device consists of a pull-string that extends exterior to the at least one storage receptacle.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION

Figure 1:
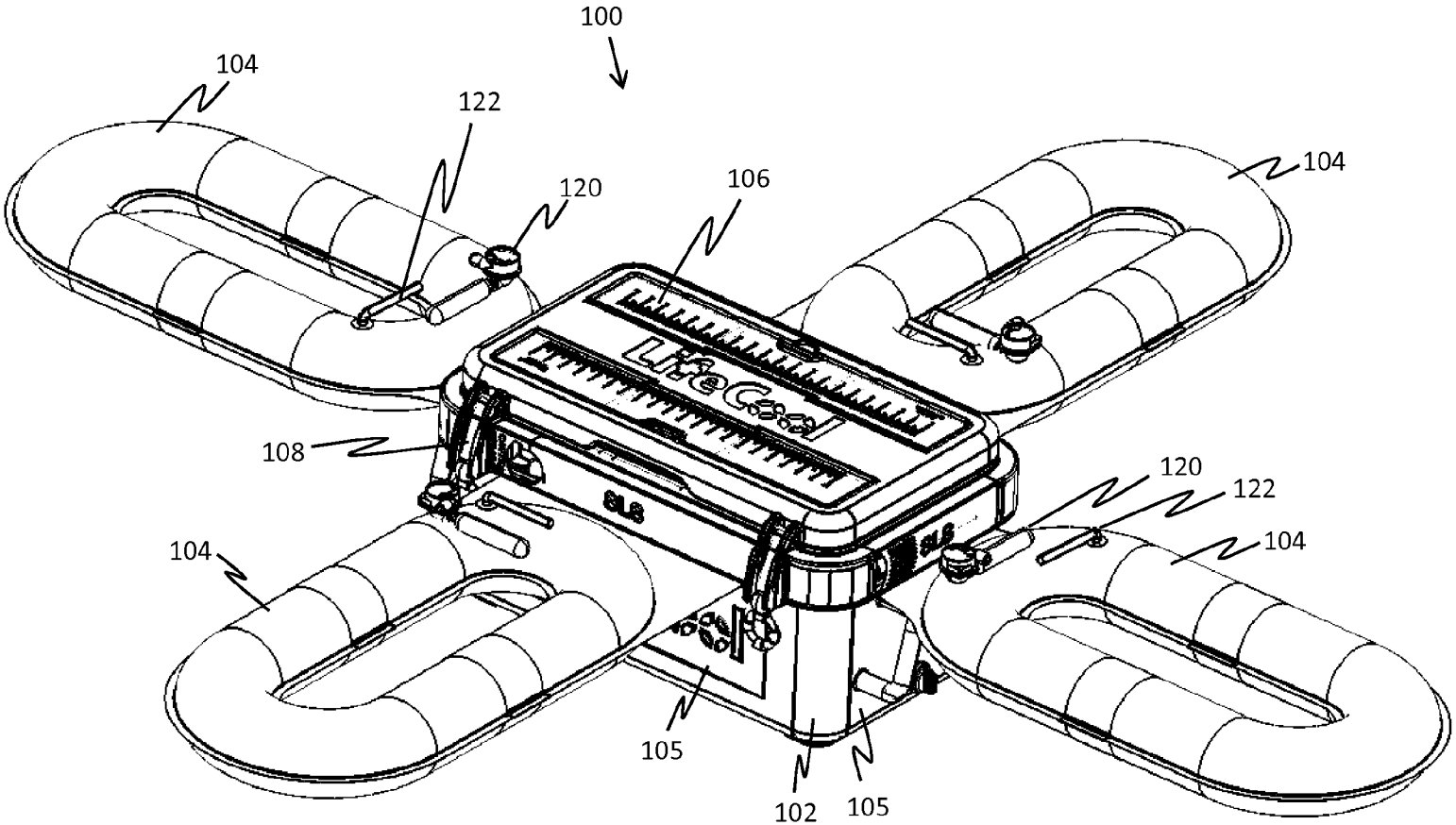
FIG. 1 is an illustration of a perspective view of a marine lifesaving system in a deployed mode, according to one embodiment.
Figure 2:
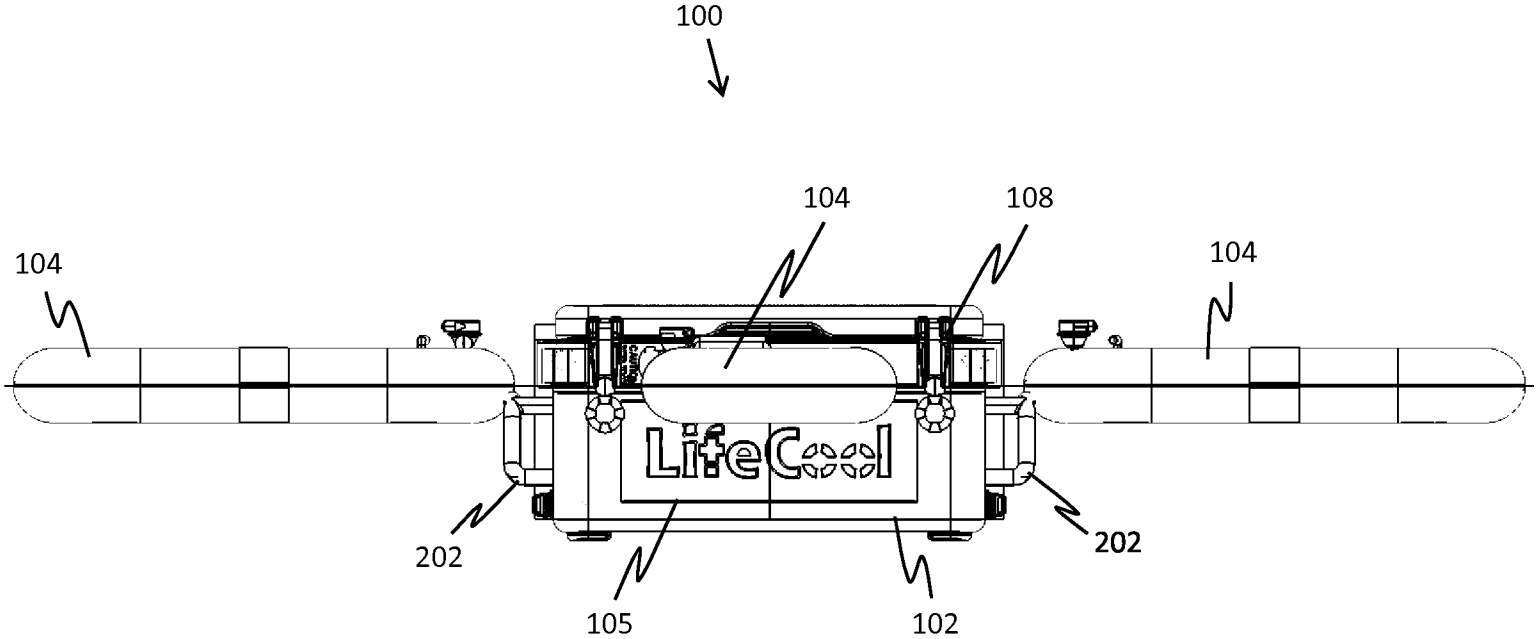
FIG. 2 is an illustration of a front view of a marine lifesaving system in a deployed mode, according to one embodiment.
Figure 3:
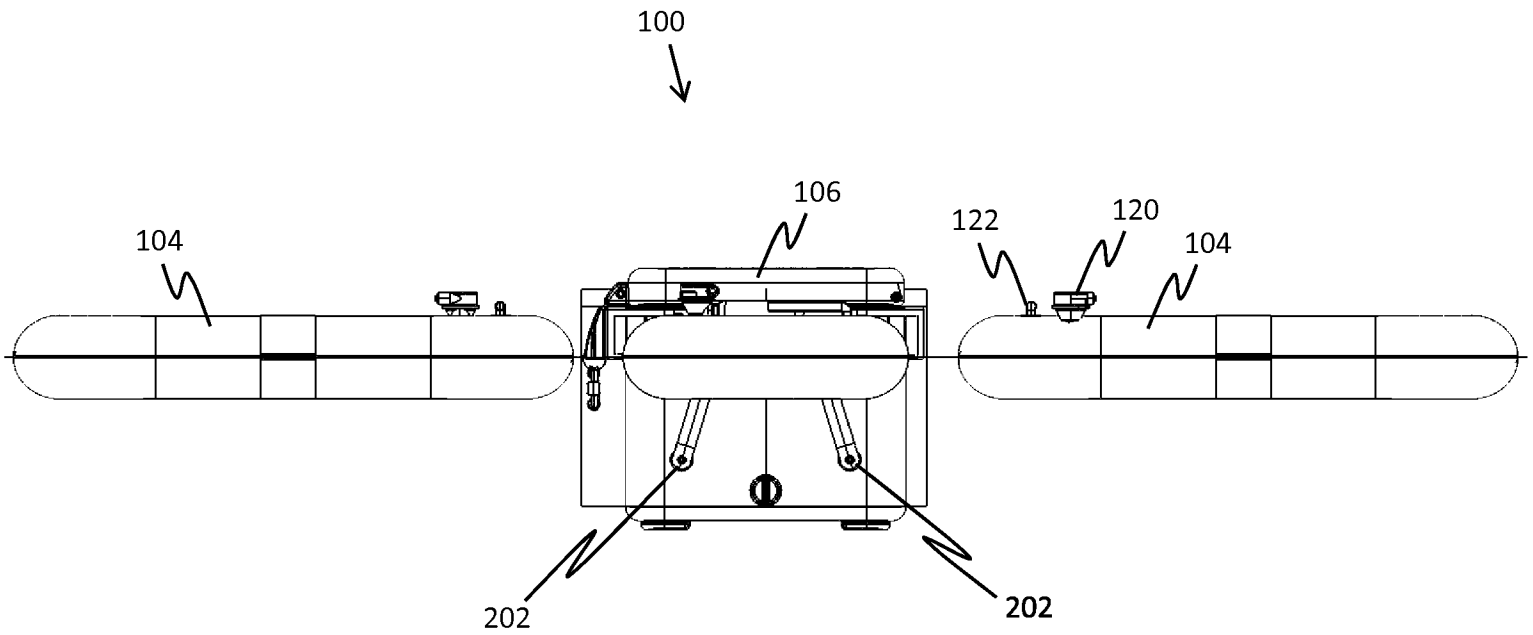
FIG. 3 is an illustration of a side view of a marine lifesaving system in a deployed mode, according to one embodiment.
Figure 4:
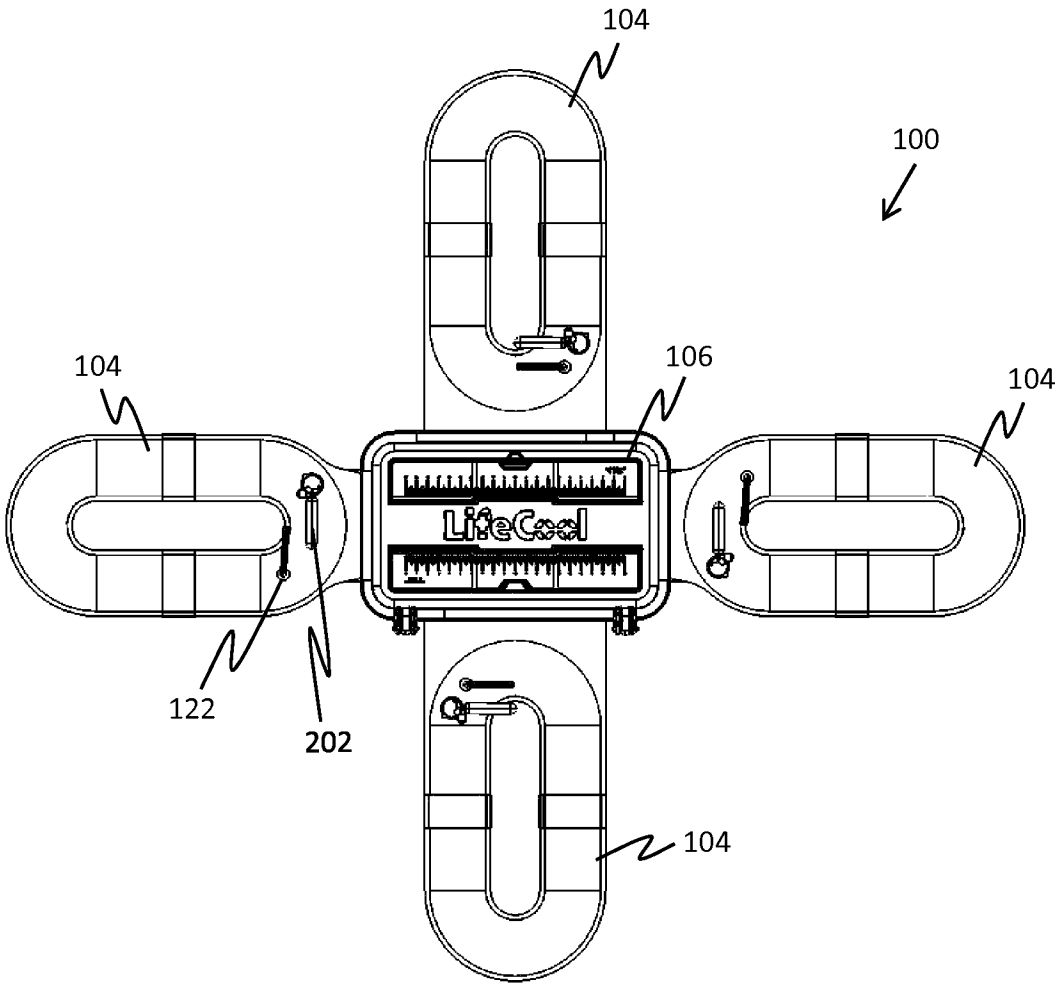
FIG. 4 is an illustration of a top view of a marine lifesaving system in a deployed mode, according to one embodiment.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention. Instead, the proper scope of the invention is defined by the appended claims.

The disclosed embodiments provide a manual-deployable or automatic-deployable marine lifesaving system integrated in an insulated container, such as a cooler. The marine lifesaving system takes advantage of the fact that insulated containers are often used to store food, beverages, fresh catch, etc., during fishing or other explorations while onboard a vessel or a boat. Coolers are easily portable and can be carried onboard large offshore fishing vessels, yet compact enough to be carried on boats, kayaks and even paddle watercrafts. Coolers not only function to maintain their contents at a reduced temperature, but also have inherent buoyancy characteristics. As such, it is common in capsizing or sinking emergencies that coolers are often found floating near the vessel, often with a survivor clinging to it. Although the disclosed embodiments disclose a marine lifesaving system integrated in an insulated container, the disclosed embodiments support the integration of the marine lifesaving system integrated in other types of objects, such as tackle boxes, containers of various shapes and sizes or sports equipment.

The disclosed embodiments allow victims of a capsizing or sinking boat to instantly cling on to the marine lifesaving system and activate the inflatable bladders by pulling on a drawstring, if the system has not automatically deployed on its own. Additionally, the marine lifesaving system inhibits victims from drifting away and keeps survivors together, thereby enhancing visibility for potential rescuers. The marine lifesaving system does not interfere with other personal floatation devices, thereby supplementing any existing devices that are commensurate with their flotation properties. The disclosed embodiment further improve over the prior art by providing a flotation device that is easily stowed on an open deck, thereby providing an easily accessible flotation device in the event of a capsizing or sinking. The disclosed embodiment further improve over the prior art by providing a flotation device that does not require assembly, and, due to its small size, can easily be used on smaller vessels. The disclosed embodiment further improve over the prior art by providing a small, inexpensive flotation device that does not cause visual clutter, and can further double as a cooler for food and beverages.

The marine lifesaving system 100 will now be described with reference to FIGS. 1 through 9 below, according to one embodiment. FIGS. 1-4 are illustrations of the marine lifesaving system 100 in a deployed mode, while FIGS. 5-8 are illustrations of the marine lifesaving system 100 in a storage mode. Deployed mode refers to the state in which all of the bladders of the system 100 have been inflated such that a floatation device is created for the use of a person that has suffered a capsize or overboard event. Storage mode refers to the state in which the bladders of the system 100 are not inflated, but rather are stowed for use, and the system 100 can be used to store food and beverages. In this way, the system 100 has a dual use—one use for each mode.

The marine lifesaving system 100 may include an insulated container 102, such as a cooler, comprising a plurality of walls 105 and a lid 106. The plurality of walls may include a right-side wall, a left side wall, a front wall, a rear wall, a bottom wall defining a main insulated enclosed space 1020 (see FIG. 10) in which food, beverages and the like may be stored so as to maintain the desired temperature of same. The system 100 also includes at least one locking means 108 to selectively and co-operatively secure said lid 106 with said insulated container 102. Locking means 108 may be a latch or other fastening device. If there are multiple locking means, each locking means may be equidistant from each other. The locking means 108 may also include loops or hoops 602 that are used to pull down the respective latch and that may further be used as tie downs to tie down the system 100 when there is turbulence or other disruptive condition resulting in the system 100 moving excessively on-board a vessel. The system 100 also includes at least one drain valve 702 that, when opened, allows for fluid or water inside the main insulated enclosed space to drain out.

The marine lifesaving system 100 may include four inflatable bladders 104 having a toroidal shape, though this is not meant to be a limitation. The inflatable bladders 104 may have a variety of other shapes known to be used for flotation devices in the art. Each inflatable bladder 104 may include a gas inflation system 120 (described in more detail below with reference to FIG. 9) and an oral inflator 122 for inflating the inflatable bladder by a person using his mouth. The oral inflator 122 may include a straw-like device that allows air to flow into the inflatable bladder but not out of the bladder.

The system 100 may further include handles 202 located on the sides of the insulated container 102, thereby allowing users to hold on to the container with their hands when in the deployed mode or allowing users to pick up or handle the system 100. Further, defined within lid 106 there may be defined a sub-lid 804 that, when opened, provides access to a small three-dimensional space 1030 (see FIG. 10) located within the lid 106. This provides a small space for stowing small but important items, such as a wallet, keys, flashlight, GPS radio, communications radio, etc. The system 100 may further include lights (not shown) located on the sides of the insulated container 102 or on the lid 106, wherein said lights may be manually activated by a user by pressing a button or pulling a lever/switch, or automatically activated when a water sensor device senses the presence of water. Lid 106 or sub-lid 804 also includes one or more measuring scales 802 printed or engraved/embossed on lid 106 or sub-lid 804. The measuring scales 802 may be used to measure the size of fish or other items, or may be used to determine size and scale when a photo of the system 100 is taken from a large distance, such as from a rescue helicopter.

Figure 6:
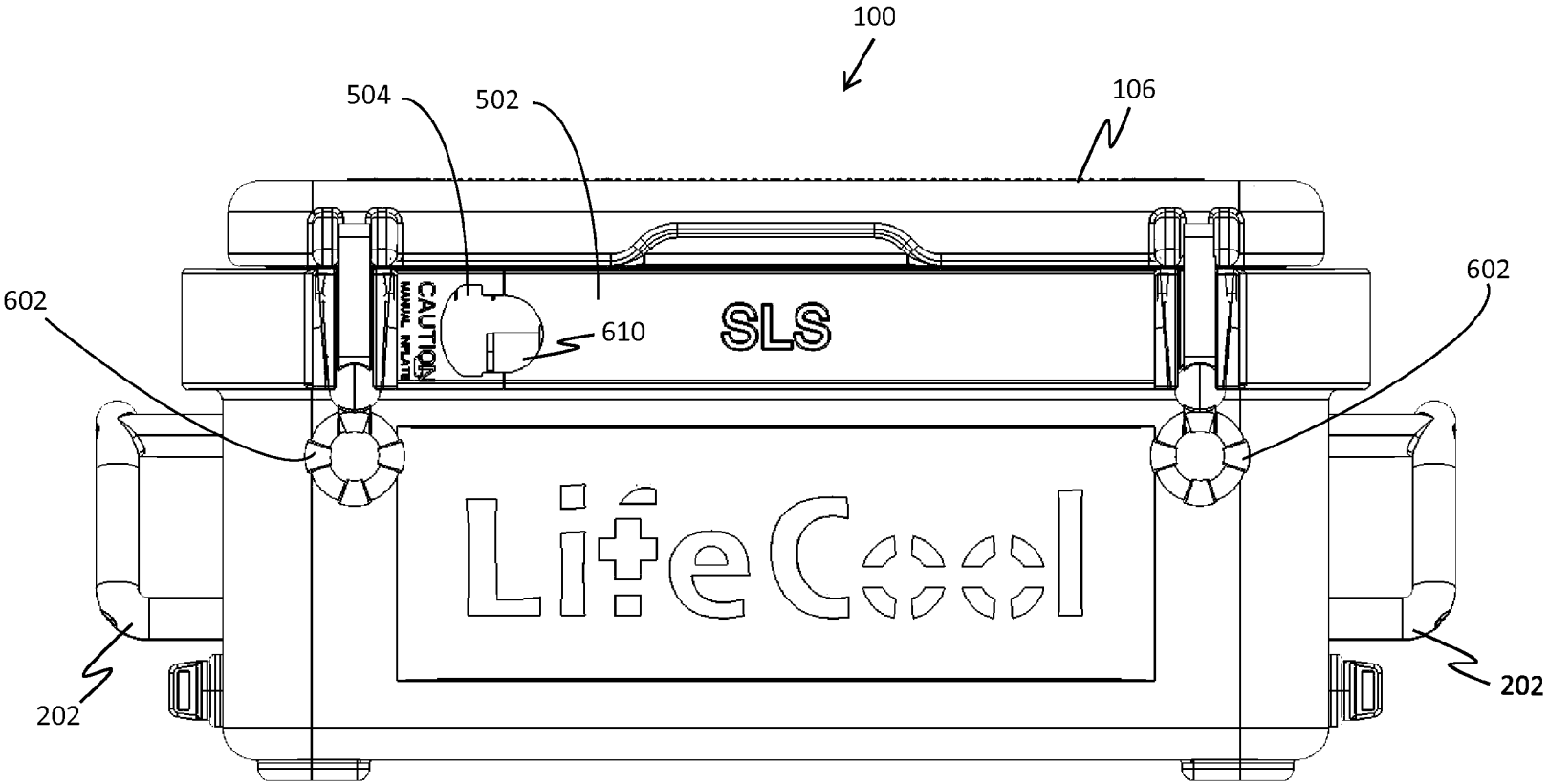
FIG. 6 is an illustration of a front view of a marine lifesaving system in a storage mode, according to one embodiment.
Figure 7:
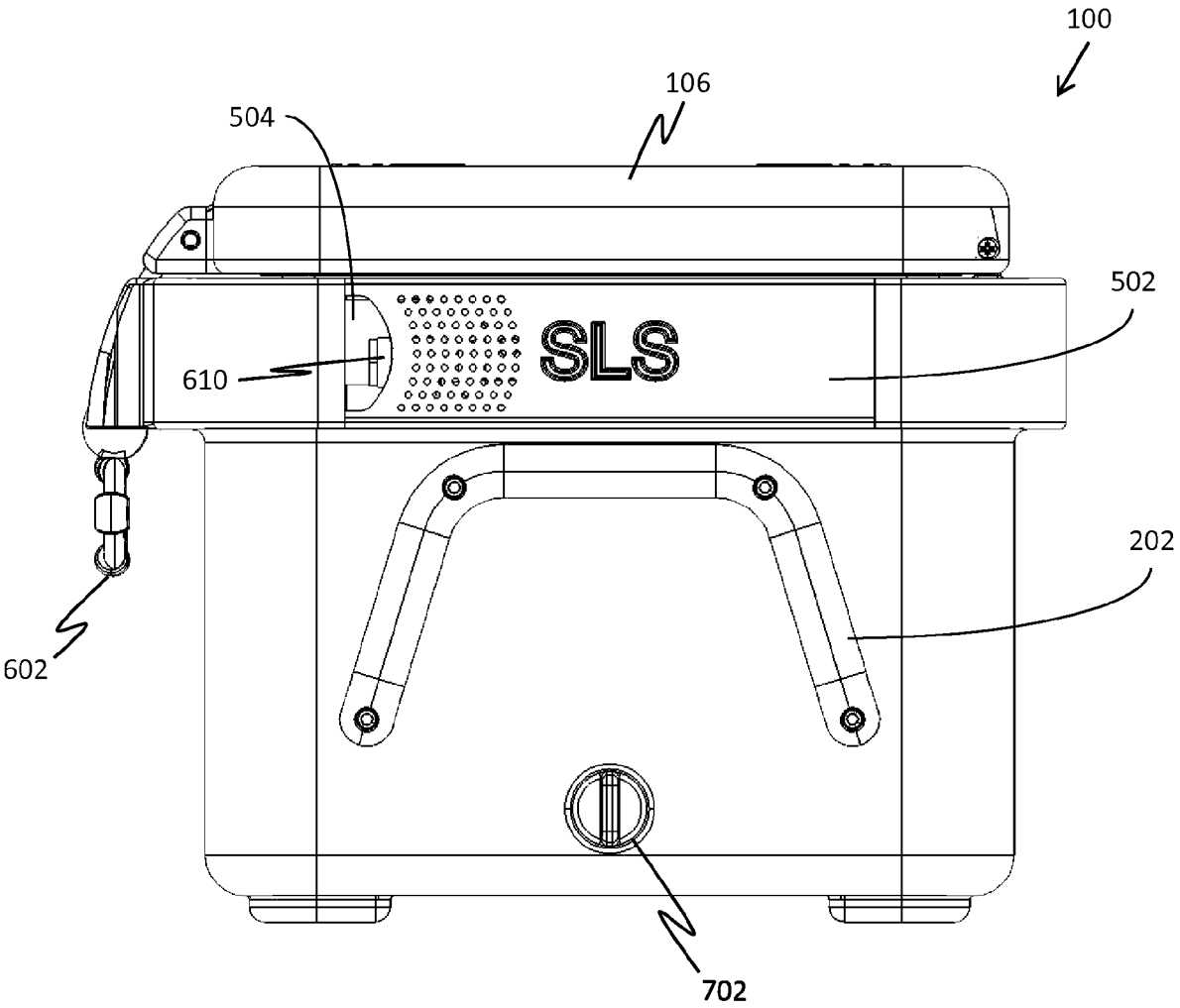
FIG. 7 is an illustration of a side view of a marine lifesaving system in a storage mode, according to one embodiment.
Figure 8:
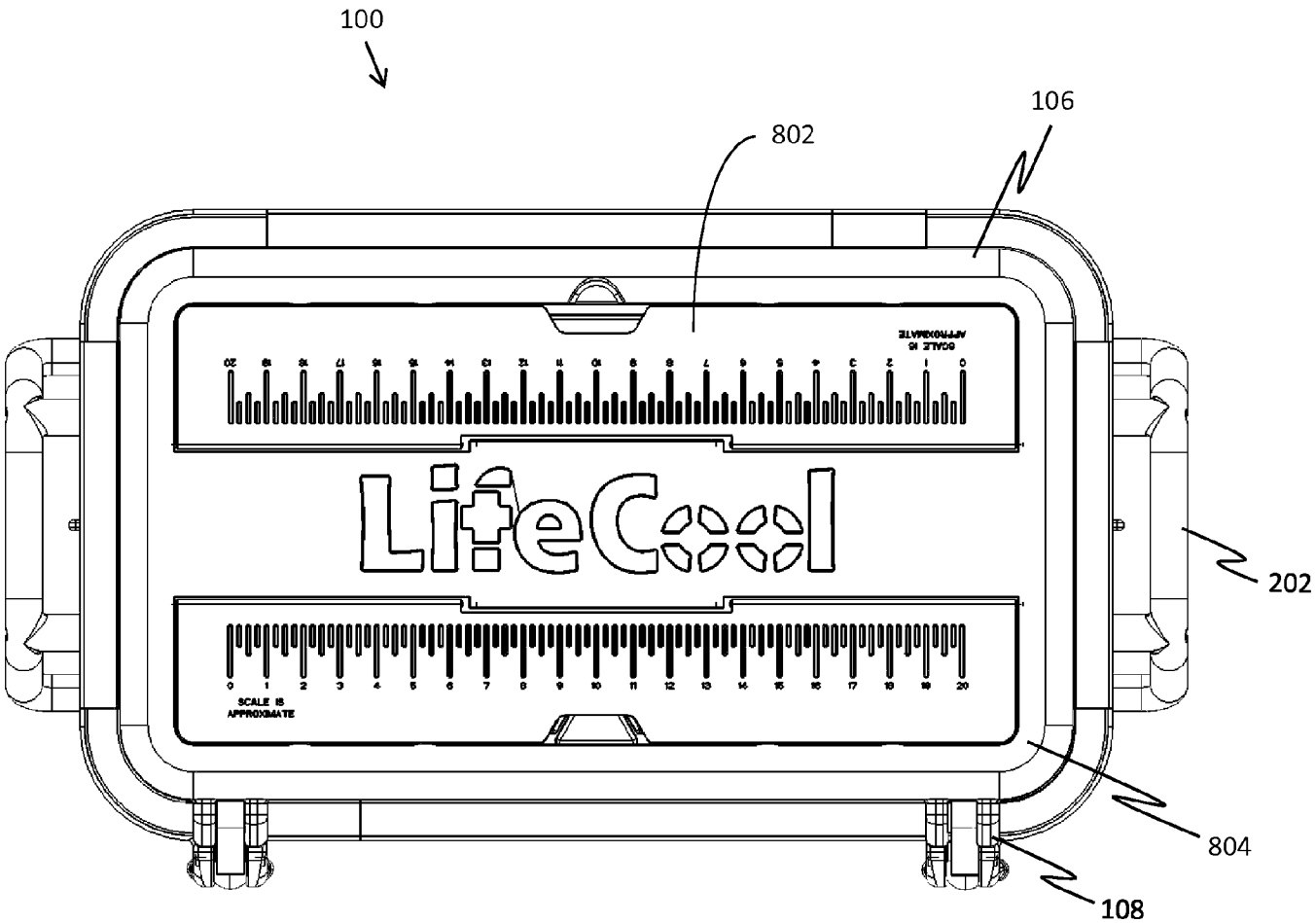
FIG. 8 is an illustration of a top view of a marine lifesaving system in a storage mode, according to one embodiment.

Defined in one or more of the walls, or the lid 106, of the insulated container 102 is at least one storage receptacle 502, which may comprise a rectangular holder storage receptacle. Stowed in each storage receptacle 502 is one or more bladder systems (see 104), and one or more gas inflation systems 120 (see FIG. 9) connected to the bladder systems, when the system 100 is in the storage mode. Each bladder system may be interconnected with each other by one or more hoses or other means. The bladder systems may be coiled and held intact within said walls of each rectangular holder storage receptacle. Each storage receptacle 502 also includes an orifice 504 configured for allowing a bladder system to exit the rectangular holder storage receptacle when the bladder system is inflated. FIG. 6 shows that interior items within storage receptacle 502 and viewable via orifice 504.

Figure 9:
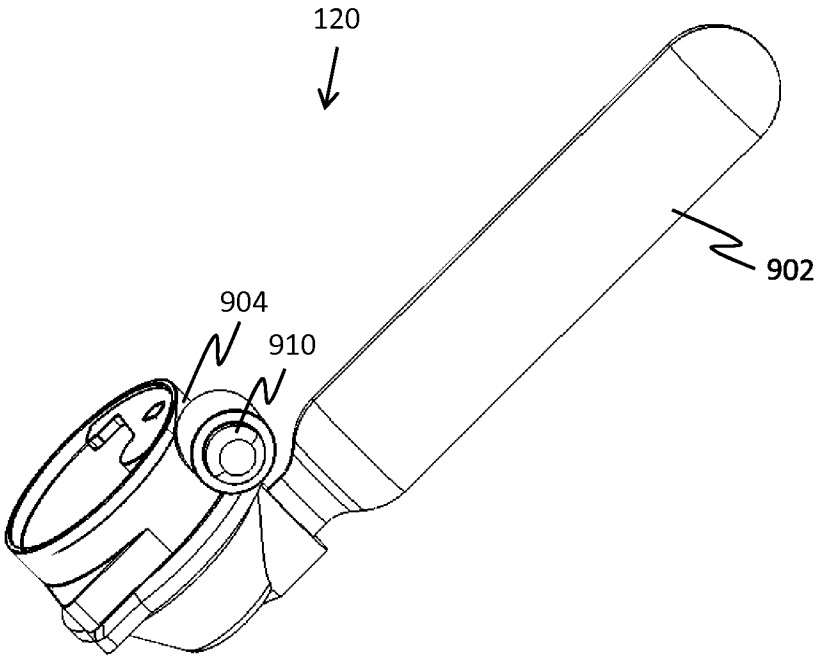
FIG. 9 is an illustration of a perspective view of a gas inflation system of a marine lifesaving system, according to one embodiment.

FIG. 9 is an illustration of a perspective view of a gas inflation system 120 of a marine lifesaving system 100, according to one embodiment. The gas inflation system 120 may include a compressed gas canister 902 coupled with a valve 904 that acts as a conduit that regulates the flow of gas from the compressed gas canister 902 to a connected bladder system 104. In one embodiment, an activation device 910 is communicatively coupled with the valve 904, wherein the activation device is configured to activate the valve 904 to allow gas from the compressed gas canister 902 to enter a connected bladder system 104. In one embodiment, the activation device 910 is a water sensor, such as a fresh water sensor, a salt water sensor, or a water detector, wherein the activation device is configured to activate the valve 904 to allow gas from the compressed gas canister 902 to enter a connected bladder system 104 when water or salt water is sensed. A water detector is an electronic device that is designed to detect the presence of water and provide a signal in response thereof. A common design is a small cable or device that relies on the electrical conductivity of water to decrease the resistance across two contacts. In one embodiment, activation device 910 will only trigger inflation when submerged in a predefined depth of water (such as 4 inches) and not inadvertently due to rain, spray or humidity.

In another embodiment, the activation device 910 is a manually activated device, wherein the activation device is configured to activate the valve 904 to allow gas from the compressed gas canister 902 to enter a connected bladder system 104 when a pull-string or pull tab is pulled by a user. FIG. 6 shows pull-tab 610 located within storage receptacle 502 and viewable via orifice 504. In another embodiment, the activation device 910 is both a manually activated device and an automatically deployable device that includes a water sensor.

In one embodiment, a wall or portion of a wall (such as wall 1006) of each storage receptacle 502 is configured to be easily removed or detached, such as by a person's hand or by a bladder system that is being inflated. This feature allows a person to more easily access the pull-tab 610 and further allows for the unobstructed inflation of each bladder system when said inflation has been activated by activation device 910.

In yet another embodiment, the marine lifesaving system 100 comprises only one activation device 910 that is configured to activate all valves (such as the four valves shown in the Figures) to allow gas from all compressed gas canisters (such as the four canisters shown) to enter all connected bladder systems (such as the four bladder systems sown) when either a pull-string/pull tab is pulled by a user or water is sensed by the device 910. In yet another embodiment, the marine lifesaving system 100 comprises only one activation device 910, multiple bladder systems (such as the four bladder systems as shown in the Figures) that are interconnected via hoses or other means, and one gas inflation system connected to the bladders, wherein the gas inflation system includes one or more compressed gas canisters and one or more valves. In this embodiment, the single activation device 910 activates the one or more valves to inflate the multiple bladders when a pull string is pulled or water is sensed.

Figure 5:
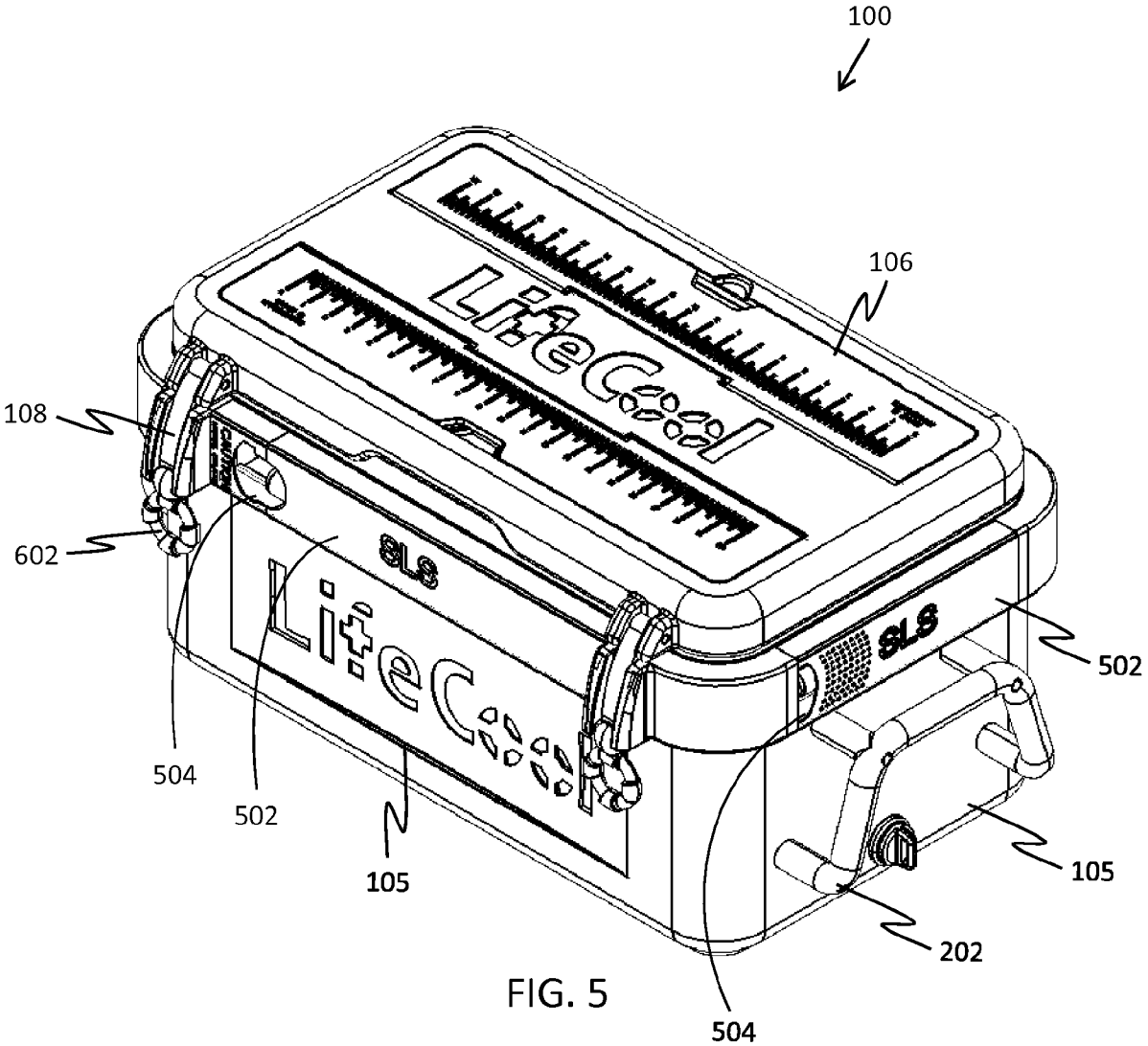
FIG. 5 is an illustration of a perspective view of a marine lifesaving system in a storage mode, according to one embodiment.
Figure 10:
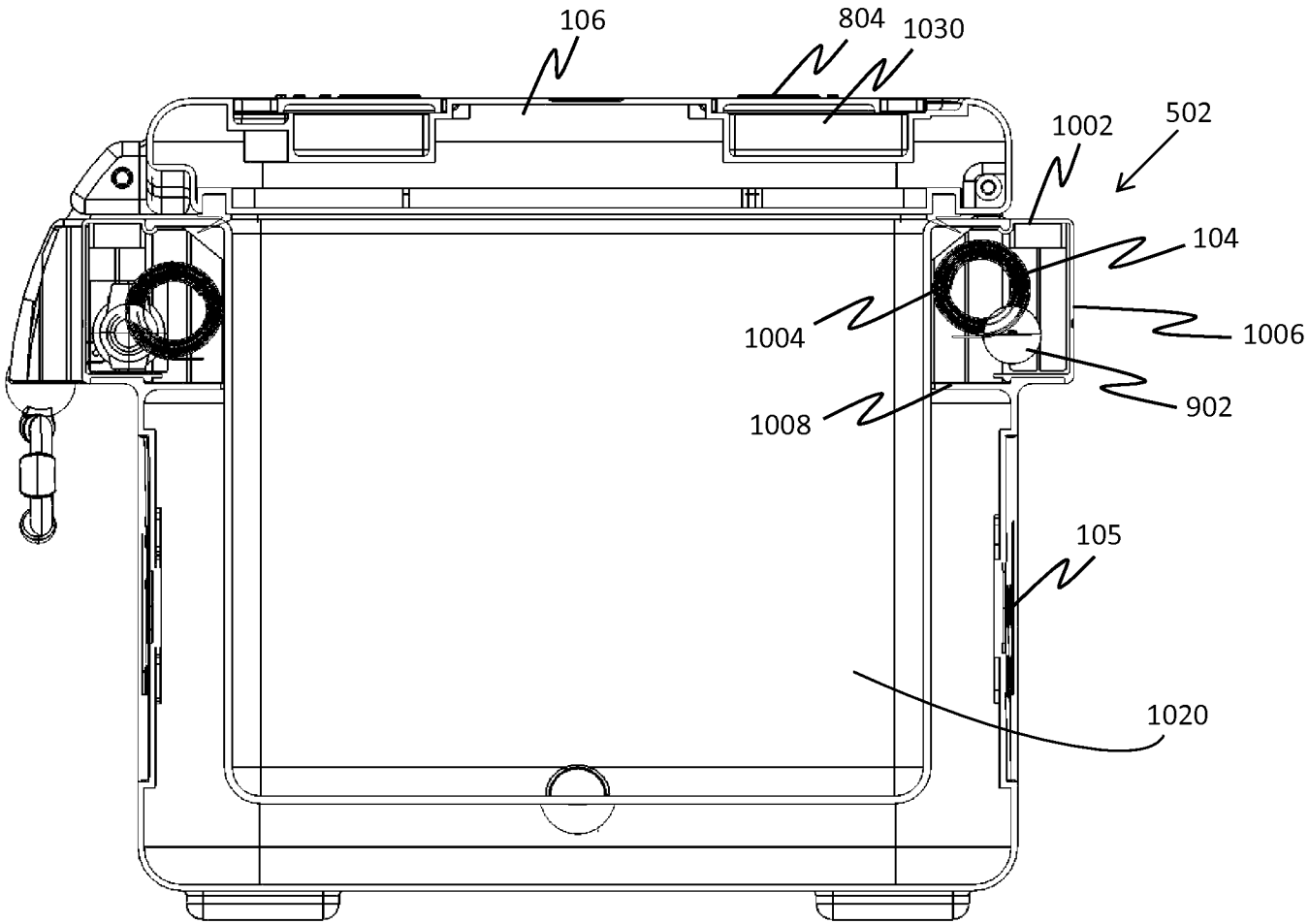
FIG. 10 is an illustration of a cross-sectional view of a marine lifesaving system, according to one embodiment.

FIG. 10 is an illustration of a cross-sectional view of a marine lifesaving system 100 in the storage mode, according to one embodiment. In one embodiment, each storage receptacle 502 is a rectangular shaped three dimensional structure embedded or partially embedded into a wall 105 of the container 102. FIG. 10 shows that receptacle 502 holds the gas canister 902 and a connected bladder system 104 that is coiled or rolled up and stowed away ready for deployment when activated. The receptacle 502 includes an interior wall 1004 that is flush or co-planar with the interior wall of the container that defines the main insulated enclosed space 1020. The receptacle 502 also includes a bottom wall 1008 and a top wall 1002 that extends outwards such that they jut out past the thickness of the side wall 105 of the container. The interior ends of the bottom wall 1008 and a top wall 1002, however, are flush with the interior wall of the container that defines the main insulated enclosed space 1020, such that bottom wall 1008 and a top wall 1002 do not extend into the enclosed space 1020. Because bottom wall 1008 and top wall 1002 extend outwards such that they jut out past the thickness of the side wall 105 of the container, the outer wall 1006 is set off from and parallel to the exterior surface of the wall 105 of the container. Thus, this embodiment allows for the use of the space created by the thickness of the wall 105 of container 102 without compromising or using any space within the main insulated enclosed space 1020. Also, this embodiment effectively results in a shape for system 100 wherein the receptacles located on all four sides of the container 102 create a ring or circumferential belt that protrudes from the container 102 just below the lid 106. This feature is best seen in FIG. 5.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. A marine lifesaving system, comprising:

an insulated container comprising a plurality of walls and a lid;

at least one locking means to selectively and co-operatively secure said lid with said insulated container;

at least one storage receptacle defined in one or more of the walls, or the lid, of the insulated container;

at least one bladder system located in the at least one storage receptacle;

at least one valve connected to each of the at least one bladder systems;

at least one compressed gas canister connected to each of the at least one bladder systems via a valve; and an activation device for activating the at least one valve, thereby inflating the at least one bladder system with gas held by the at least one gas canister, wherein the activation device comprises a water sensor device located exterior to the at least one storage receptacle.

2. The marine lifesaving system of claim 1, wherein the plurality of walls comprises a right-side wall, a left side wall, a front wall, a rear wall, and a bottom wall defining an insulated enclosed space.

3. The marine lifesaving system of claim 2, wherein the at least one bladder system is stowed within the dimensions of a storage receptacle comprising a rectangular holder storage receptacle.

4. The marine lifesaving system of claim 3, wherein the activation device activates the inflation of the at least one bladder system into a flotation device, when the water sensor device senses water.

5. The marine lifesaving system of claim 4, wherein the at least one bladder system comprises multiple bladder systems and wherein all bladder systems are interconnected.

6. The marine lifesaving system of claim 5, wherein each of the bladder systems are coiled within a corresponding rectangular holder storage receptacle.

7. The marine lifesaving system of claim 6, wherein each rectangular holder storage receptacle comprises an orifice configured for allowing a bladder system to exit the rectangular holder storage receptacle when the bladder system is inflated.

8. A marine lifesaving system, comprising:

an insulated container comprising four walls and a lid;

at least one locking means to selectively and co-operatively secure said lid with said insulated container;

four storage receptacles, each storage receptacle defined in one of the walls of the insulated container;

four bladder systems, each bladder system located in a storage receptacle;

four valves, each valve connected to a bladder system;

four compressed gas canisters, each compressed gas canister connected to a bladder system via a valve; and four activation devices, each activation device for activating a valve, thereby inflating a bladder system with gas held by a gas canister, wherein the activation device comprises a water sensor device located exterior to the storage receptacles.

9. The marine lifesaving system of claim 8, wherein the four walls define an insulated enclosed space for storing food.

10. The marine lifesaving system of claim 9, wherein each bladder system is stowed within the dimensions of a storage receptacle comprising a rectangular holder storage receptacle.

11. The marine lifesaving system of claim 10, wherein each activation device activates the inflation of a bladder system into a flotation device, when the water sensor device senses water.

12. The marine lifesaving system of claim 11, wherein the four bladder systems are interconnected.

13. The marine lifesaving system of claim 12, wherein each rectangular holder storage receptacle comprises an orifice configured for allowing a bladder system to exit the rectangular holder storage receptacle when the bladder system is inflated.

* * * * *